United States Patent [19]

Igel

[11] Patent Number: 4,878,344

[45] Date of Patent: Nov. 7, 1989

[54] METHOD AND DEVICE FOR AUOTMATICALLY SPLICING YARN ON A RING SPINNING MACHINE

[75] Inventor: Wolfgang Igel, Ebersbach/Fils, Fed. Rep. of Germany

[73] Assignee: Zinser Textilmaschinen GmbH, Fed. Rep. of Germany

[21] Appl. No.: 230,801

[22] Filed: Aug. 10, 1988

[30] Foreign Application Priority Data

Aug. 11, 1987 [DE] Fed. Rep. of Germany ..... 3726720

[51] Int. Cl.[4] ..... D01H 13/14; B65H 54/88; B65H 63/032

[52] U.S. Cl. ..... 57/261; 57/264; 57/305; 57/81; 242/35.6 E

[58] Field of Search ..... 57/22, 80, 261, 264, 57/305; 242/35.6 E

[56] References Cited

U.S. PATENT DOCUMENTS

| | | | |
|---|---|---|---|
| 2,500,343 | 3/1950 | Carrette | 57/80 |
| 2,780,908 | 2/1957 | Bechtler | 57/80 |
| 3,203,634 | 8/1965 | Furst | 242/35.6 E |
| 3,842,579 | 10/1974 | Bartling | 57/80 X |
| 4,375,149 | 3/1983 | Hartmannsgruber | 57/264 X |
| 4,404,791 | 9/1983 | Wolf | 57/264 X |
| 4,570,433 | 2/1986 | Nickolay | 57/261 X |

FOREIGN PATENT DOCUMENTS

| | | |
|---|---|---|
| 1276523 | 8/1968 | Fed. Rep. of Germany . |
| 3013174 | 10/1981 | Fed. Rep. of Germany . |

*Primary Examiner*—Donald Watkins

*Attorney, Agent, or Firm*—Shefte, Pinckney & Sawyer

[57] ABSTRACT

In a yarn splicing operation on a ring spinning machine wherein a broken end of yarn is drawn into a suction tube in position for splicing, the suction is reduced after the yarn is in position to avoid damage or destruction of the yarn as it is being held by suction. The reduction in suction is accomplished by the opening of a bypass, the restriction of the tube or a reduction in the speed in the motor of the suction pump.

5 Claims, 3 Drawing Sheets

METHOD AND DEVICE FOR AUOTMATICALLY SPLICING YARN ON A RING SPINNING MACHINE

BACKGROUND OF THE INVENTION

The present invention relates to a method and device for automatically splicing yarn on a ring spinning machine, and more particularly to such a method and device wherein a broken end of yarn to be spliced is drawn by suction into a tube in position for splicing and a sensor senses the presence of the yarn end in the tube to initiate a splicing operation.

It is known in yarn splicers for ring spinning machines to utilize a jet of air to blow a broken yarn end from a bobbin of yarn and utilize suction to draw the yarn end into a suction tube for positioning the yarn end for splicing.

Conventionally, a sensor is located in the suction tube to sense the presence of the yarn end and in response to the sensing the device terminates the air jet and initiates the subsequent splicing process. Such a sensor can be, e.g., a mechanical feeler or an optical sensor.

The suction in the suction tube must be of sufficient force to draw they yarn end that has been blown loose by the air jet and draw it into a bell at the end of the suction tube and then into the tube in position for splicing. However, the suction must not be so strong that it damages the yarn end, e.g., by untwisting it or disintegrating the end so that it is shortened to a length less than desirable for splicing. It has been difficult to balance the suction to obtain optimum engagement and positioning of the yarn end and yet not damage or disintegrate the yarn end.

SUMMARY OF THE INVENTION

The present invention provides a method and device that function to apply sufficient suction for engaging and positioning the yarn end in the tube while avoiding damage or disintegration of the yarn end after it is in position.

The present invention accomplishes the desired result by reducing the amount of suction applied to the yarn in response to sensing that the yarn end is in position for splicing.

The device of the present invention includes means for reducing the amount of suction, which in one embodiment is in the form of means for reducing the operating speed of the suction pump that creates the suction in the tube.

In another embodiment the means for reducing the amount of suction is in the form of means for restricting the tube. In a further embodiment, the means for reducing suction includes a normally closed bypass in the tube downstream of the position of the yarn end and means for opening the bypass to reduce suction in the tube at the yarn end in response to the sensing of the presence of the yarn in position for splicing.

Other and further advantages and features of the present invention will be apparent from the accompanying drawings and following detailed description.

DETAILED DESCRIPTION OF THE PREFERRED EMBODIMENTS

Figure 1:
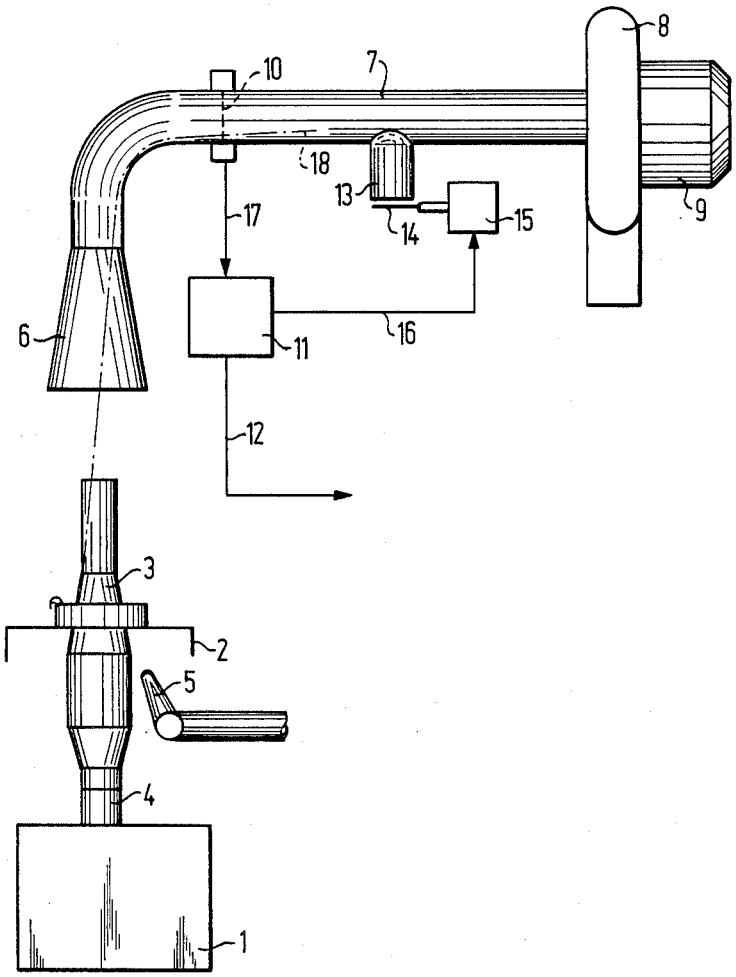
FIG. 1 is a schematic side elevation of a portion of a ring spinning machine incorporating a preferred embodiment of the present invention.

The portion of the ring spinning machine illustrated in FIG. 1 includes a spindle 4, which is one of a row of spindles mounted on a bearing plate 1 of the spinning machine. Each spindle 4 has mounted thereon a yarn tube 3 around a traveler (not shown) rotates on a reciprocating ring rail 2. An air jet 5 is operable under the ring rail 2 to direct a blast of air upwardly to initiate an automatic cycle of yarn splicing upon the occurrence of a yarn break. A suction bell 6 is located above the yarn tube 3 and is connected to a suction tube 7 that is connected to a suction pump 8 driven by motor 9.

A sensor 10 is located inside the suction tube 7 and is in any conventional form, such as a mechanical feeler lever or an optical sensor. This sensor 10 is provided for the purpose of sensing the presence of a yarn end 18 in the suction tube 7, which sensing activates a control device 11 by an electrical connection line 17. This control device 11 initiates the further functions of the splicing operation by an electrical connection line 12 leading to other controls (not shown) of the splicer.

According to the present invention, the sensing of the presence of a yarn end 18 in position for splicing not only functions to initiate the splicing operation but importantly provides a sensing in response to which the suction in the suction tube 7 is reduced. This function is controlled by the control device 11 to which the sensor 10 is connected by the electrical lead line 17.

The suction reduction can be accomplished by varying the speed of the motor 9 of the suction pump 8, by utilizing adjustable restricting means in the yarn tube 7, such as means 22 or by opening a bypass or by any other suitable means. In the embodiment illustrated in FIG. 1, a bypass 13 is illustrated in the suction tube downstream of the position of the yarn end 18. This bypass 13 is normally closed by a cover plate 14. Means for opening the bypass 18 is provided in the form of an actuator mechanism 15 connected to the cover plate 14 and operable to move the cover plate into a bypass opening position in response to the sensor 10 sensing the presence of a yarn end 18, which sensing is transmitted to the actuator 15 through the electrical line 17 to the control device 11 and therefrom through the electrical connector line 16 to the actuator 15. Upon opening of the bypass 13 suction is drawn therethrough, thereby reducing the suction in the portion of the tube 7 in which the yarn end is located. Simultaneously with this bypass opening operation, the splicing operation is actuated from the control unit 11 through the electrical connecting line 12.

Figure 2:
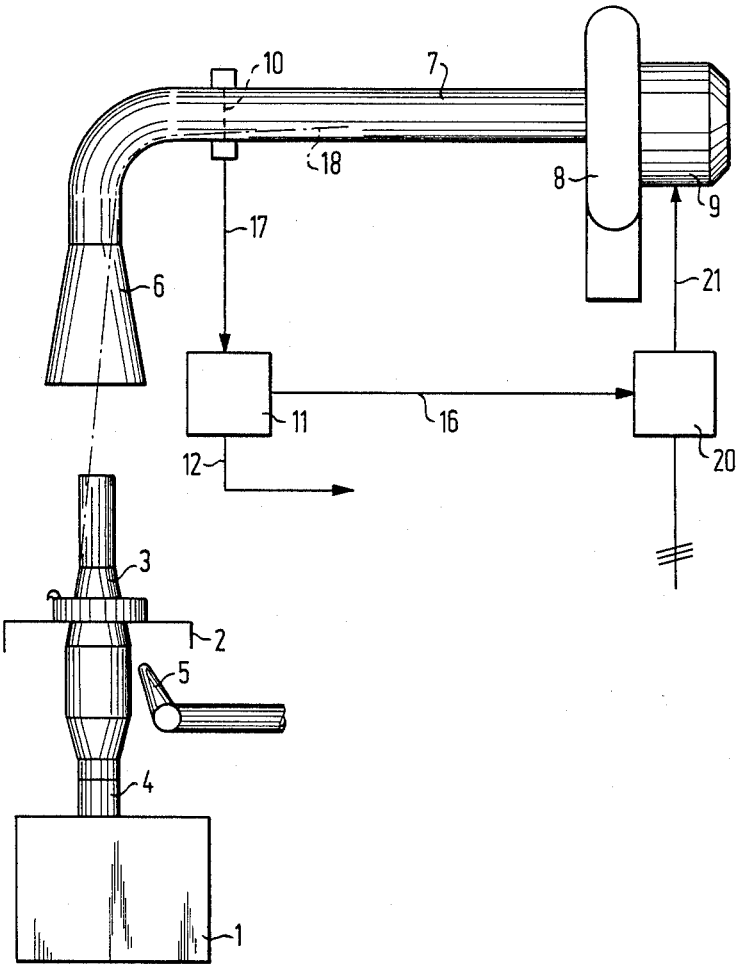
FIG. 2 is a schematic side elevation of a portion of a ring spinning machine incorporating another preferred embodiment of the present invention.
Figure 3:
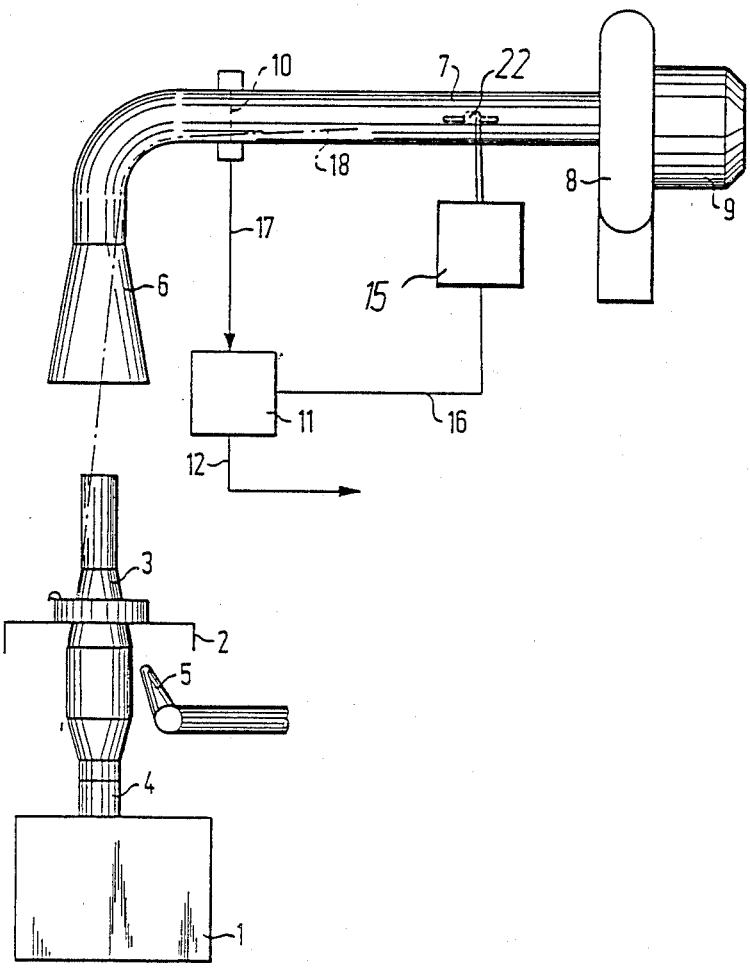
FIG. 3 is a schematic side elevation of a portion of a spinning machine incorporating another preferred embodiment of the present invention.

In the embodiment illustrated in FIG. 2, the means for reducing suction includes a control component 20 that is connected by an electrical lead line 21 to the motor 9 that drives the suction pump 8. The control element 20 is connected by the electrical connection line 16 to the control unit 11 for actuation of the motor speed reduction and associated reduction in suction.

From the foregoing it is apparent that with the suction reduction accomplished by the present invention in response to the positioning of a yarn end in the suction tube 7, the yarn end is held in a non-damaging manner in the suction tube 7 so that the splicing operation can be performed without damage or destruction of the yarn end.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In a method for automatically splicing yarn on a ring spinning machine wherein a broken end of yarn to be spliced is drawn by suction into a tube in position for splicing and the presence of the yarn end in the tube in position for splicing is sensed to initiate a splicing operation, the improvement comprising reducing the amount of suction applied to the yarn end in the tube in response to said sensing of the yarn end in position for splicing to a reduced level of suction sufficient to maintain the yarn end in a non-damaging manner in the tube in position for splicing.

2. In a device for automatically splicing yarn on a ring spinning machine wherein a broken end of yarn to be spliced is drawn by suction means into a tube in position for splicing and sensing means senses the presence of the yarn end in the tube to initiate a splicing operation, the improvement comprising means for reducing the amount of suction applied to the yarn end in the tube in response to said sensing means sensing the presence of the yarn end in position for splicing to a reduced level of suction sufficient to maintain the yarn end in a nondamaging manner in the tube in position for splicing.

3. In a device for automatically splicing yarn according to claim 2 wherein the suction means is a suction pump connected to said tube, said improvement being characterized further in that said means for reducing the amount of suction is means for reducing the operating speed of said suction pump.

4. In a device for automatically splicing yarn according to claim 2, said improvement being characterized further in that said means for reducing the amount of suction is means for restricting said tube in response to said sensing means sensing the presence of the yarn end in position for splicing.

5. In a device for automatically splicing yarn according to claim 2, said improvement being further characterized in that said means for reducing the amount of suction comprises a normally closed bypass in said tube downstream of the position of the yarn end and means for opening said bypass to reduce suction in the tube at the yarn end in response to said sensing means sensing the presence of the yarn end in position for splicing.

* * * * *